US009527280B2

(12) United States Patent
Kondo et al.

(10) Patent No.: US 9,527,280 B2
(45) Date of Patent: Dec. 27, 2016

(54) PRINTING APPARATUS, PRINTING MEDIUM, AND PRINTING METHOD

(71) Applicant: SEIKO EPSON CORPORATION, Tokyo (JP)

(72) Inventors: Manabu Kondo, Nagano (JP); Yasuhiko Yoshihisa, Nagano (JP); Takayuki Tanaka, Nagano (JP); Yohei Nunokawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/288,954

(22) Filed: May 28, 2014

(65) Prior Publication Data

US 2014/0354721 A1 Dec. 4, 2014

(30) Foreign Application Priority Data

May 31, 2013 (JP) ..... 2013-115024

(51) Int. Cl.

| | |
|---|---|
| ***B41J 23/00*** | (2006.01) |
| ***B41J 2/07*** | (2006.01) |
| ***B41J 2/01*** | (2006.01) |
| ***B41J 3/407*** | (2006.01) |
| *B41M 5/00* | (2006.01) |

(52) U.S. Cl.

CPC .. *B41J 2/07* (2013.01); *B41J 2/01* (2013.01); *B41J 3/407* (2013.01); *B41M 5/0047* (2013.01)

(58) Field of Classification Search

USPC ..... 347/5, 9, 14, 19, 101; 355/22

See application file for complete search history.

(56) References Cited

U.S. PATENT DOCUMENTS

| | | | | |
|---|---|---|---|---|
| 6,880,905 | B2 * | 4/2005 | Kasahara | 347/5 |
| 2006/0221160 | A1 * | 10/2006 | Ouchi | B41J 11/0025 347/101 |
| 2010/0002205 | A1 * | 1/2010 | Suzuki | 355/22 |
| 2010/0013903 | A1 | 1/2010 | Suzuki | |

FOREIGN PATENT DOCUMENTS

JP 2010-023230 A 2/2010

* cited by examiner

*Primary Examiner* — Lam Nguyen

(74) *Attorney, Agent, or Firm* — Global IP Counselors, LLP

(57) ABSTRACT

For a lenticular in which a lens body having low shape accuracy is disposed on one end portion, when the other end portion of the lenticular is detected, a position of a carriage at the time of detecting the end portion of the lenticular is stored in a buffer as a paper end position, a carriage motor is controlled such that the carriage is separated from a home position and moved in a main scanning direction, and a printing head is controlled such that an ink discharge having a color according to printing data is started at the paper end position. Since the lens body having high shape accuracy is disposed on the end portion of the lenticular, it is possible to land the ink onto a more suitable position with respect to the lens body, thereby allowing printing quality to be improved.

6 Claims, 6 Drawing Sheets

PRINTING APPARATUS, PRINTING MEDIUM, AND PRINTING METHOD

BACKGROUND

1. Technical Field

The present invention relates to a printing apparatus, a printing medium, and a printing method.

2. Related Art

As disclosed in JP-A-2010-23230, a printing apparatus in which printing is performed by discharging ink onto a recording medium having a lenticular lens in which a plurality of semi-cylinder-shaped lens components are disposed in parallel on a recording layer has been proposed in the related art. In this apparatus, a cutout width of an edge portion of the lens component which constitutes the lenticular lens is detected, and a discharge position of the ink is adjusted on the basis of the cutout width, thereby allowing printing to be performed in accordance with an arrangement of the lens components even when the edge portion of the lens component of the lenticular lens has a cutout portion.

In the printing apparatus described above, the cutout width of the edge portion of the lens component is detected, and the discharge position of the ink is adjusted on the basis of the cutout width, but there is a demand for improving printing quality by landing the ink onto the recording medium having a lens sheet such as the lenticular lens in which a cutout portion is formed on the edge portion of the lens component with high positioning accuracy by a more simple method.

SUMMARY

An advantage of some aspects of the invention is to improve printing quality with respect to a printing medium having a lens sheet by a more simple method.

A printing apparatus, a printing medium, and a printing method of the invention have adopted the following means.

According to an aspect of the invention, there is provided a printing apparatus which performs printing by discharging fluid from a printing head onto a printing medium having a lens sheet in which a plurality of lens bodies are disposed in parallel, in which the printing medium is formed such that the lens body disposed on one end portion has low shape accuracy compared to the other lens bodies, and in which the printing apparatus includes a control unit which controls the printing head such that the fluid is discharged onto an end portion of the printing medium which is opposite to the one end portion as a discharge start position.

According to the printing apparatus of this aspect, the printing medium is formed such that the lens body disposed on the one end portion has low shape accuracy compared to the other lens bodies, and the printing head is controlled such that the fluid is discharged onto the end portion of the printing medium which is opposite to the one end portion as the discharge start position. A fluid discharge is started from the end portion on which the lens body having high shape accuracy is disposed as a printing start position, and thus it is possible to perform printing by discharging the fluid onto a suitable position by a more simple method compared to a case of detecting a cutout width of an edge portion of the lens body, thereby allowing printing quality to be improved. Here, the "lens sheet" may be a lenticular lens, fly-eye lens, or the like.

In the printing apparatus according to this aspect, a printing head movement unit which reciprocates the printing head in a main scanning direction may be further included, and the control unit may control the printing head and the printing head movement unit such that the fluid is discharged from the printing head while the printing head is moved in a direction to the one end portion from the other end portion of the printing medium. According to the printing apparatus of this aspect, it is possible to improve printing quality by a more simple method even in the printing apparatus provided with the printing head movement unit which reciprocates the printing head in the main scanning direction.

In the printing apparatus according to this aspect which is provided with the printing head movement unit which reciprocates the printing head in the main scanning direction, the control unit may control the printing head and the printing head movement unit such that the fluid is discharged when the printing head is moved in the direction to the one end portion from the other end portion of the printing medium, and may control the printing head and the printing head movement unit such that the printing head is moved at a velocity which is faster than the velocity at the time of moving the printing head in the direction to the one end portion from the other end portion without discharging the fluid when the printing head is moved in a direction to the other end portion from the one end portion of the printing medium. According to the printing apparatus of this aspect, it is possible to improve printing throughput.

In addition, in the printing apparatus according to this aspect which is provided with the printing head movement unit which reciprocates the printing head in the main scanning direction, an end portion detection unit which detects the end portion of the printing medium in the main scanning direction may be further included, and the control unit may control the printing head and the printing head movement unit such that the fluid is discharged onto the end portion of the printing medium which is detected by the end portion detection unit as the discharge start position. According to the printing apparatus of this aspect, the printing head and the printing head movement unit are controlled such that the fluid is discharged onto the end portion of the printing medium which is detected by the end portion detection unit as the discharge start position, thereby allowing printing quality to be reliably improved.

In the printing apparatus according to this aspect which is provided with the printing head movement unit which reciprocates the printing head in the main scanning direction and the end portion detection unit which detects the end portion of the printing medium in the main scanning direction, the end portion detection unit may be attached to the printing head, and the control unit may control the printing head movement unit and the end portion detection unit such that the end portion is detected by the end portion detection unit while the printing head is moved in the direction to the other end portion from the one end portion of the printing medium, and then may control the printing head and the printing head movement unit such that a fluid discharge is started from a position of the detected end portion while the printing head is moved in the direction to the one end portion from the other end portion of the printing medium. According to the printing apparatus of this aspect, it is possible to improve throughput and printing quality, compared to a case where the fluid discharge or the detection of the end portion by the end portion detection unit is performed, when the printing head is moved in the direction to the other end portion from the one end portion of the printing medium and when the printing head is moved in the direction to the one end portion from the other end portion of the printing medium.

In addition, in the printing apparatus according to this aspect which is provided with the printing head movement unit which reciprocates the printing head in the main scanning direction and the end portion detection unit which detects the end portion of the printing medium in the main scanning direction, the end portion detection unit may be attached to the printing head, and the control unit may control the printing head movement unit and the end portion detection unit such that the end portion of the printing medium is detected by the end portion detection unit while the velocity of the printing head is decelerated. According to the printing apparatus of this aspect, it is possible to detect the end portion of the printing medium more reliably, and to improve printing quality more reliably.

Further, in the printing apparatus according to this aspect which is provided with the printing head movement unit which reciprocates the printing head in the main scanning direction and the end portion detection unit which detects the end portion of the printing medium in the main scanning direction, a transport unit which transports the printing medium to a fluid discharge region in which the printing head is able to discharge the fluid may be further included, and the control unit may control the printing head movement unit, the end portion detection unit, and the transport unit such that the printing medium is transported by a predetermined amount and then the end portion is detected by the end portion detection unit while the printing head is moved in the direction to the other end portion from the one end portion of the printing medium, and may control the printing head and the printing head movement unit such that a position of the end portion is estimated on the basis of a transport amount according to the transport unit when the end portion is not able to be detected by the end portion detection unit, and the fluid discharge is started from the estimated position of the end portion. According to the printing apparatus of this aspect, it is possible to improve printing quality even when the printing medium is shifted with respect to the main scanning direction and transported.

According to another aspect of the invention, there is provided a printing medium onto which printing is performed by discharging fluid by a printing apparatus, in which a part of an end portion of the printing medium is cut out.

According to the printing medium of this aspect, a part of the end portion is cut out, and thus it is possible to easily detect the end portion. Accordingly, in the printing apparatus which performs printing by discharging the fluid onto the end portion as the printing start position, the control unit which controls the fluid to be discharged onto the end portion as the printing start position by detecting the end portion in which the cutout portion is formed is provided, thereby allowing printing to be performed from the end portion by easily detecting the end portion on which the cutout portion is formed.

According to still another aspect of the invention, there is provided a printing method in which printing is performed by discharging fluid from a printing head onto a printing medium having a lens sheet in which a plurality of lens bodies are disposed in parallel such that the lens body disposed on one end portion has low shape accuracy compared to the other lens bodies, in which the fluid is discharged from the printing head onto an end portion of the printing medium which is opposite to the one end portion as a discharge start position.

According to the printing method of this aspect, the printing medium is formed such that the lens body disposed on the one end portion has low shape accuracy compared to the other lens bodies, and the fluid is discharged from the printing head onto the other end portion of the printing medium which is opposite to the one end portion as the printing start position. The fluid discharge is started from the end portion on which the lens body having high shape accuracy is disposed as the printing start position, and thus it is possible to perform printing by discharging the fluid onto the suitable position by a more simple method compared to a case of detecting the cutout width of the edge portion of the lens body, thereby allowing printing quality to be improved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
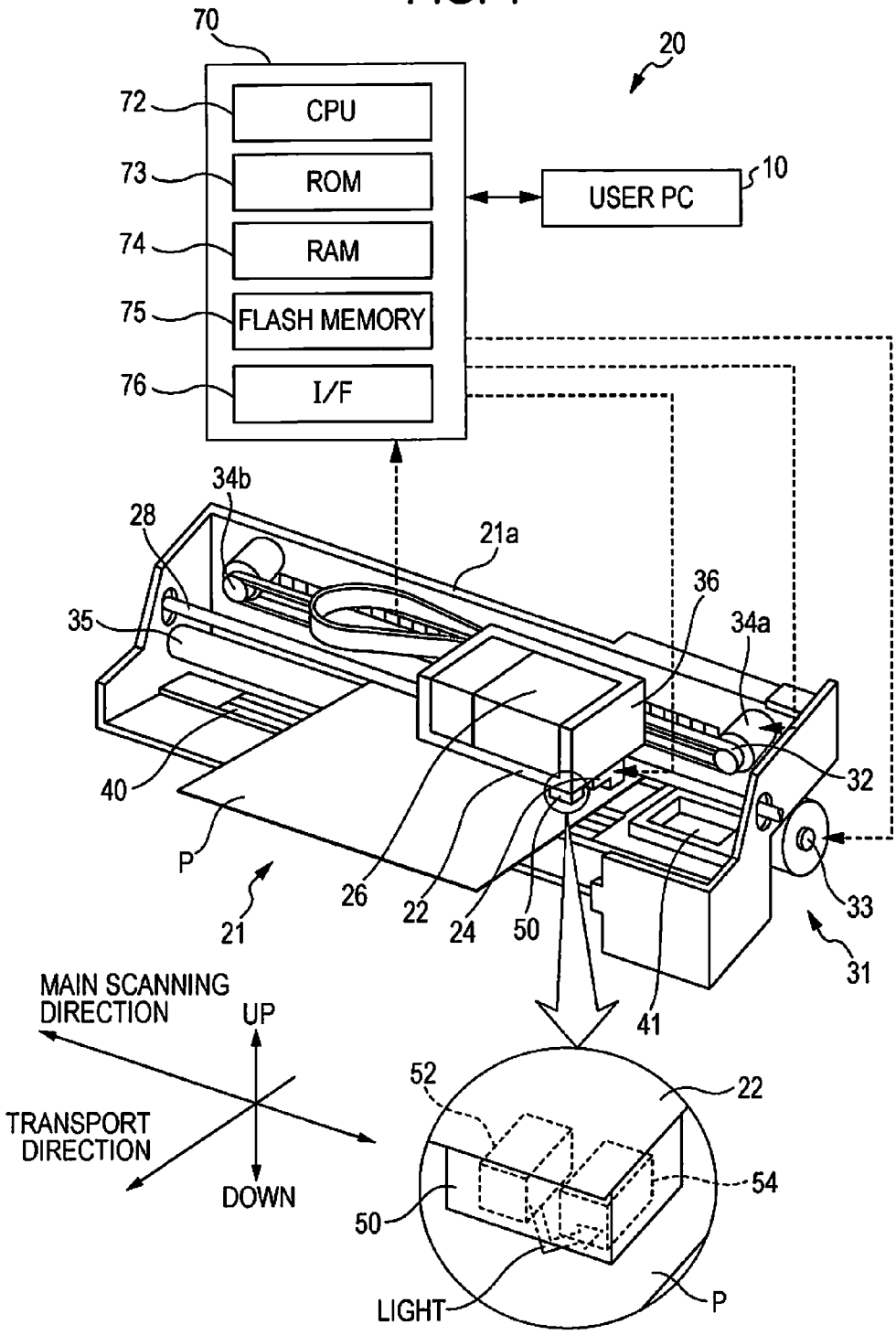
FIG. 1 is a configuration diagram illustrating a schematic configuration of an ink jet printer.

Next, embodiments of the invention will be described with reference to the drawings. FIG. 1 is a configuration diagram illustrating a schematic configuration of an ink jet printer 20 which is an embodiment of a printing apparatus of the invention. As illustrated, the ink jet printer 20 of this embodiment includes a paper feed mechanism 31 which transports recording paper P in a transport direction (a sub-scanning direction) of FIG. 1, by the driving of a paper feed roller 35 by a paper feed motor 33, a printer mechanism 21 which performs printing by discharging ink droplets from a printing head 24 onto the recording paper P transported onto a platen 40 by the paper feed mechanism 31, a Paper Width (PW) detector 50 which is attached to the printing head 24 and detects left and right ends of the recording paper P on the platen 40, a capping device 41 which is provided on a right side of the platen 40 and seals the printing head 24 in order to prevent the printing head 24 from being dried during inactivation of the printing or the like, and a controller 70 which controls the entire ink jet printer 20. Furthermore, a position on the capping device 41 is referred to as a home position.

The printer mechanism 21 includes a carriage motor 34*a* which is disposed on a right side of a machine frame 21*a*, a driven roller 34*b* which is disposed on a left side of the machine frame 21*a*, a carriage belt 32 which is provided across the carriage motor 34*a* and the driven roller 34*b*, a carriage 22 which is reciprocated by the carriage belt 32 along a guide 28 in a main scanning direction by the driving of the carriage motor 34*a*, an ink cartridge 26 which is provided in the carriage 22 and individually contains ink of each color of CMYK, that is, cyan (C), magenta (M), yellow (Y), and black (K), in which a dye or a pigment as a coloring agent is included in water as a solvent, and the printing head 24 which is supplied with the ink from the ink cartridge 26 and discharges the ink droplet. Furthermore, on a back surface of the carriage 22, a linear encoder 36 which outputs a pulse-shaped signal according to a movement of the carriage 22 is disposed, and a position of the carriage 22 is managed by the linear encoder 36.

The PW detector 50 is configured as a light sensor including a light-emitting element 52 (for example, a light-emitting diode or the like) and a light receiving element 54 (for example, a phototransistor or the like), receives light which is emitted from the light-emitting element 52 and reflected by the recording paper P in the light receiving element 54, and converts the light to an electric signal of a voltage which has a level according to a light amount. In the PW detector 50, since the platen 40 and the recording paper P have different light reflectance from each other, it is possible to detect the left and right ends of the recording paper P by moving the PW detector 50 across the recording paper P according to reciprocation of the printing head 24 in the main scanning direction.

The controller 70 is configured as a microprocessor dominated by a CPU 72, and includes a ROM 73 which stores various processing programs or various data items, a RAM 74 which temporarily stores data, a flash memory 75 which is able to write and erase the data, an interface (I/F) 76 which performs information transaction with an external device, and input and output ports (not illustrated). A printing buffer region is provided in the RAM 74, and a printing job transferred from a user PC 10 which is a general-purpose personal computer through the I/F 76 is stored in the printing buffer region. To the controller 70, a positional signal from the linear encoder 36, a signal from the PW detector 50, or the like is input through the input port. In addition, from the controller 70, a drive signal to the printing head 24, a drive signal to the paper feed motor 33, a drive signal to the carriage motor 34*a*, a signal to the capping device 41, or the like is output through the output port.

In the ink jet printer 20 of this embodiment configured as above, when printing data created by the user PC 10 is received as the printing job, the received printing data is opened in the printing buffer region provided in the RAM 74, the paper feed roller 35 is rotated according to the drive of the paper feed motor 33, and the recording paper P is transported and fed onto the platen 40. Then, the printing head 24 and the carriage motor 34*a* are driven such that the ink is discharged from the printing head 24 while the carriage 22 is moved within a movement range of the main scanning direction on the basis of the printing data of one pass, the paper feed roller 35 is rotated whenever the printing is ended, and the recording paper P of one pass is transported (hereinafter, referred to as a normal printing process). By repeating the normal printing process, printing is performed with respect to the recording paper P, and when the printing is completed with respect to the recording paper P of one sheet, the paper feed roller 35 is rotated to eject the recording paper P.

Here, in the normal printing process, the controller 70 causes each color ink to be discharged by driving the printing head 24 while the carriage 22 is moved over the printing region on the basis of the printing data, and the drive of the printing head 24 to be stopped when the carriage 22 arrives at an end position (a head drive stop position) of the printing region. In addition, the controller 70 controls the carriage motor 34*a* such that the carriage 22 is accelerated from a state of being stopped, moved within the printing region at a substantially constant rate, and decelerated and stopped when the drive of the printing head 24 is stopped. For this reason, in the normal printing process, a movement range (a CR movement range) of the carriage 22 from a CR movement start position which starts the movement of the carriage 22 to a CR movement end position which ends (stops) the movement is able to be determined on the basis of a range which is necessary for the printing region, and acceleration and deceleration.

In addition, the ink jet printer 20 of this embodiment is able to use a plurality of types of paper having sizes different from each other such as A4 paper or B5 paper, postcard size, L-size, or the like as the recording paper P, and the recording paper P is fed based on a center of the paper regardless of the size, that is, the recording paper P is fed (transported) by using a center paper feeding.

Figure 2:
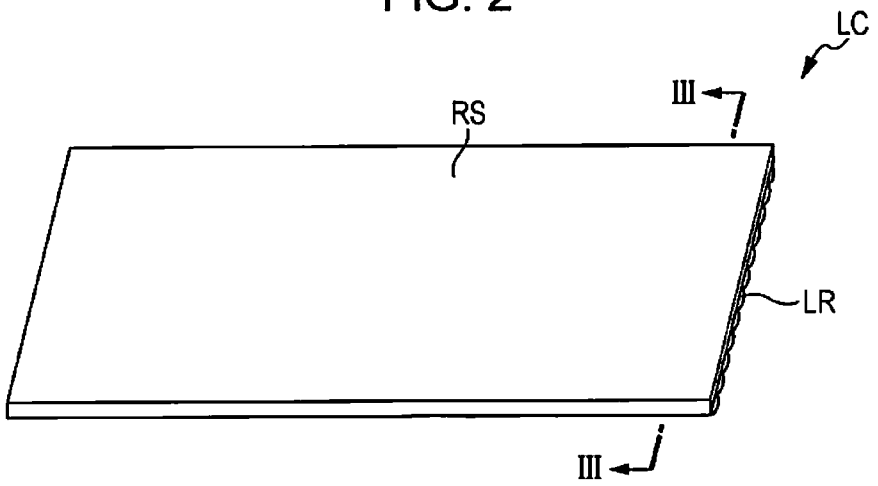
FIG. 2 is a configuration diagram illustrating a schematic configuration of a lenticular.
Figure 3:
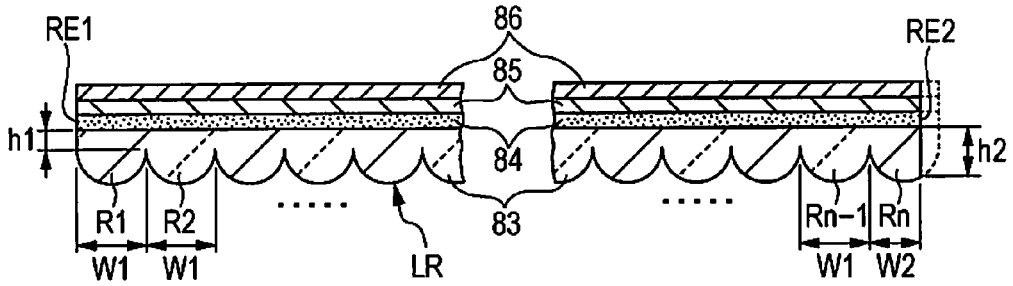
FIG. 3 is a sectional view illustrating a schematic cross-section cut along line III-III of FIG. 2.

Further, the ink jet printer 20 of this embodiment is able to use the lenticular LC as the recording paper P. FIG. 2 is a configuration diagram illustrating a schematic configuration of a lenticular LC, and FIG. 3 is a sectional view illustrating a schematic cross-section cut along line III-III of FIG. 2. The lenticular LC includes a sheet-shaped lenticular lens LR in which lens bodies R1 to Rn (n is an integer greater than or equal to 2) are arranged in parallel. The lens bodies R1 to Rn−1 not including the lens body Rn disposed on an end portion RE2 are formed in the shape of a semi-cylinder having a substantially constant shape accuracy in which widths (lens widths) in a left and right direction are approximately the same as a width W1. The lens body R1 is disposed on an end portion RE1 of the lenticular LC such that a concave portion thereof conforms to the end portion RE1. As illustrated by a broken line in FIG. 3, the lens body Rn disposed on the end portion RE2 of the lenticular LC is formed to have a lens width W2 which is smaller than the lens width W1 of the lens bodies R1 to Rn−1 and a shape in which a part of the lens bodies R1 to Rn−1 is cut out. That is, the lens body Rn has low shape accuracy compared to the lens bodies R1 to Rn−1. In the lenticular LC, an image having a parallax is directly printed on a surface RS (that is, an ink absorption layer 86) which is a side of the lenticular lens LR opposite to a concave and convex surface. The user observes the printed image through the lenticular lens LR, thereby observing the printed image as a three-dimensional image.

Figure 7A:
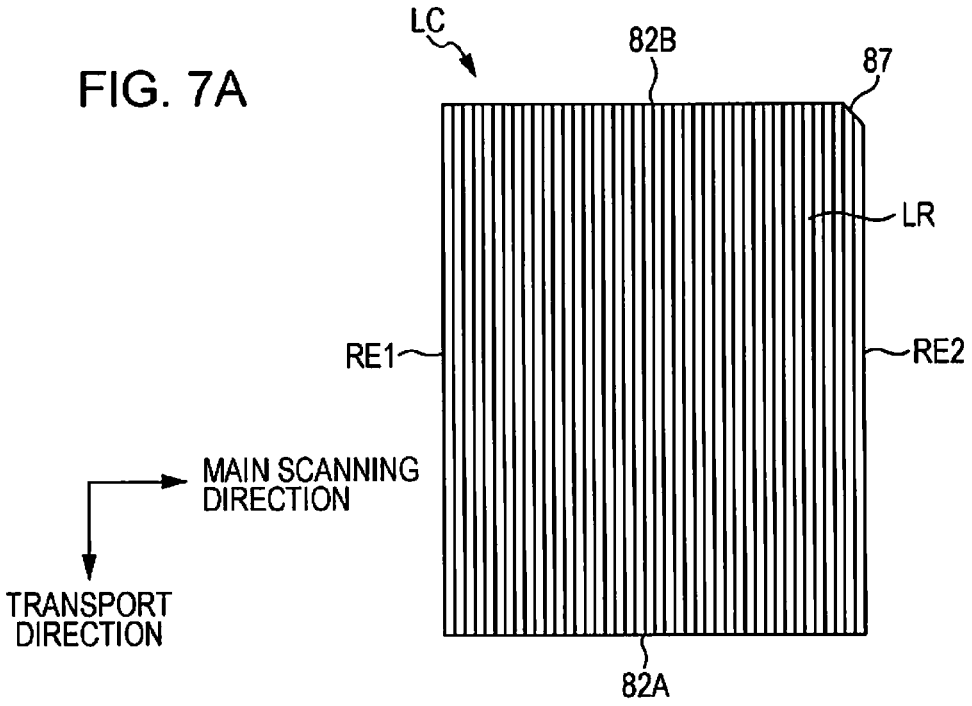
FIG. 7A is a plan view when the lenticular as an example of a recorded medium according to the invention is viewed from a lens layer side.
Figure 7B:
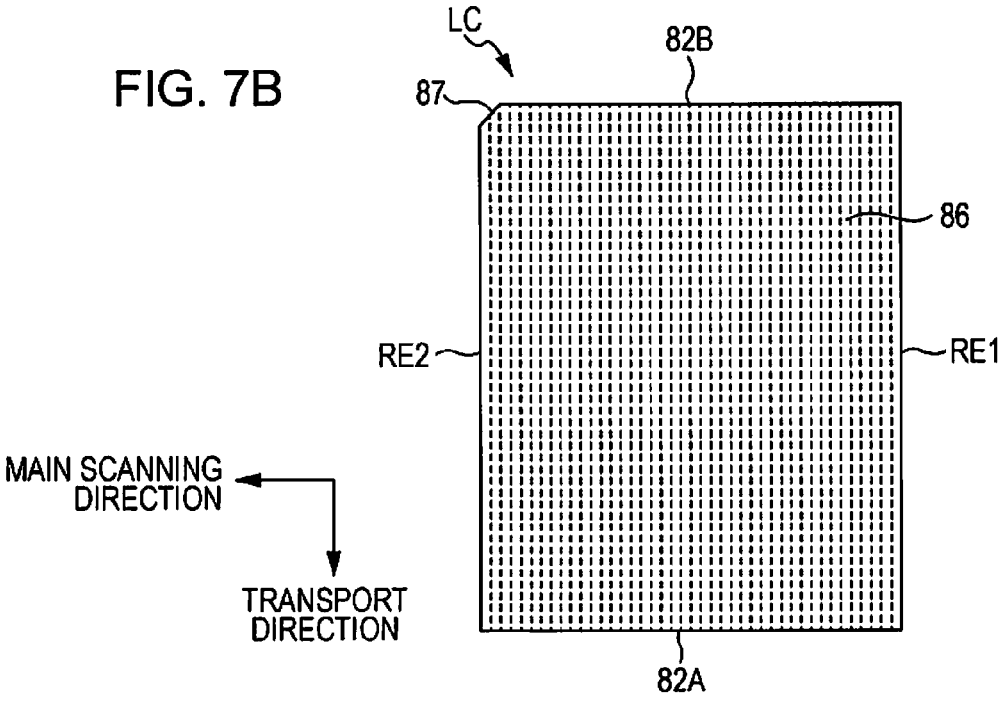
FIG. 7B is a plan view when the lenticular is viewed from an ink absorption layer side.

Further, in the lenticular LC, the end portion RE1 of one side and the end portion RE2 of the other side in the main scanning direction are asymmetrically formed. Specifically, as illustrated in FIG. 7, a part of the end portion RE2 is cut out (a part illustrated by a reference numeral 87), and thus the end portion RE1 and the end portion RE2 are in an asymmetric form. The cutout portion 87 is a spot (a discrimination mark), and when recording is performed by a printer 1 described below, it is possible to easily and reliably align an end surface of the one side, that is an end surface (the end portion RE1 in this embodiment) as a criterion in a suitable direction, thereby allowing a preferable recording result to be more reliably obtained.

Furthermore, as an example, the cutout portion 87 is formed to have an angle of 45 degrees with respect to the main scanning direction and the transport direction. That is, any shape, any position, and any size may be used insofar as a user is able to discriminate on which side the end portion RE1 as the criterion is positioned.

Figure 8:
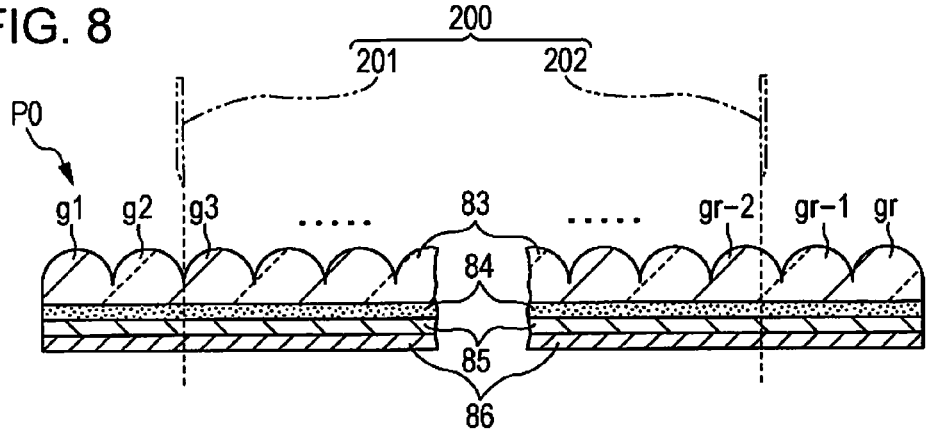
FIG. 8 is a diagram schematically illustrating a position adjustment in a punching process of the lenticular.

In addition, an entire cutting machine for forming (cutting, and punching) the lenticular LC is not illustrated, but a punching die 200 at the time of punching the lenticular LC from a lenticular P0 (a sheet which is a base of the lenticular LC and has a size larger than that of the lenticular LC) is illustrated in FIG. 8. Since the lenticular LC according to this embodiment is in the shape of a rectangle, the punching die 200 is also in the shape of a rectangle according to the shape of the lenticular LC, and configured by 4 blades in order to form (punch) 4 sides of the lenticular LC. Reference numerals 201 and 202 indicate 2 facing blades which constitute the 4 blades. The other 2 blades are omitted in FIG. 8.

As illustrated in FIG. 8, the respective lenses are indicated by reference numerals g1 to gr, and the lenticular LC after being punched, is configured by the lenses g3 to gr-2. That is, the lens g3 in FIG. 8 is a lens R1 from FIG. 3, and the lens gr-2 in FIG. 8 is a lens Rn from FIG. 3.

As illustrated in FIG. 8, a punching process performs a position adjustment of a blade 201 to a position between the adjacent lens g2 and lens g3 in the main scanning direction of FIG. 8, and then punches out the lenticular.

That is, a cutting blade (the blade 201 in FIG. 8) is precisely managed such that the cutting blade is inserted into a position which is exactly matched to a valley of the adjacent lenses gk in the invention, and a cut surface at the time of performing the cutting is the end portion RE1 of FIG. 3. The end portion RE2 of the other side in FIG. 3 is a cut surface at the time of performing the cutting without strictly managing a cutting position (without performing the position adjustment of the cutting blade).

Accordingly, as illustrated in FIG. 3, a thickness h1 of a lens layer 83 of the end portion RE1 is thinner than a thickness h2 of the lens layer 83 of the end portion RE2. Furthermore, since each thickness of the other layers not including the lens layer 83 is uniform, the total thickness of the end portion RE1 is thinner than the total thickness of the end portion RE2.

In addition, the width w1 of the lens R1 for forming the end portion RE1 is wider than the width w2 of the lens Rn for forming the end portion RE2 of the other side, and the width w1 of the lens R1 corresponds to the width (w1) of the lens R2 adjacent to the lens R1. Furthermore, widths of the other lenses Rk not including the lens on the end portion are w1.

That is, it is sufficient that the cutting position at the time of forming the end portion RE1 of the one side be precisely managed, and it is not necessary that the cutting position at the time of forming the end portion RE2 of the other side be strictly managed. Accordingly, it is possible to suppress the complication and cost increase of the cutting machine, and to prevent the cost increase of the lenticular LC.

Furthermore, for suppressing the complication and the cost increase of the cutting machine, only the end portion RE1 is strictly managed and cut, but the lenticular P0 may be measurably expanded or contracted according to various circumstances (temperature, humidity, or the like) at the time of cutting, so that the cutting position of the end portion RE2 may be managed and cut on equal terms with the end portion RE1. In such a case, the end portion RE1 may be determined on the basis of the lens width of the both ends of the lenticular LC in the main scanning direction, and when the lens width of any end portion of the lenticular LC in the main scanning direction is detected, the end portion may be determined as the end portion RE1 insofar as the lens width is within a predetermined value.

Figure 9:
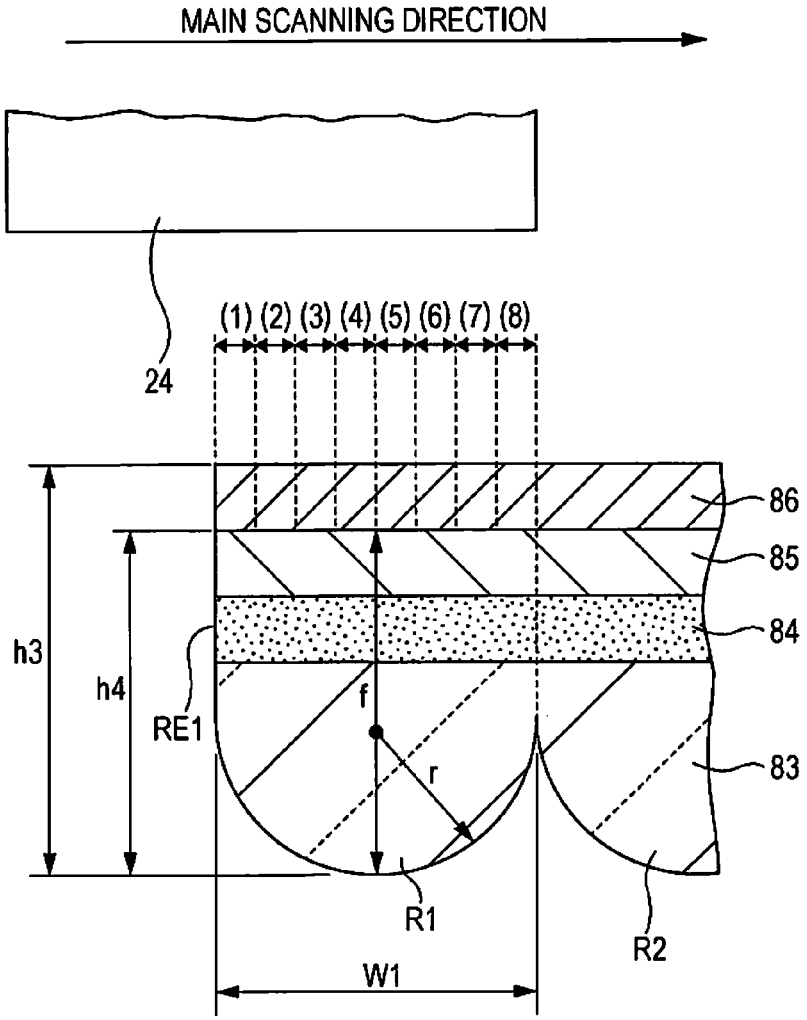
FIG. 9 is a sectional view illustrating an end surface of one side of the lenticular cut along a main scanning direction.

Furthermore, when the recording is performed with respect to the lenticular LC based on the end portion RE1 formed by being precisely cut, it is possible to prevent the image to be recorded on one lens Rk from being recorded across the other adjacent lenses. That is, in an example of FIG. 9, it is possible to accurately keep all images of (1) to (8) in the lens R1, and to obtain preferable visual effects.

Furthermore, a position of the end portion RE1 may be determined as the home position side in advance. Accordingly, it is possible to start the printing at a position adjacent to the home position side, thereby allowing throughput to be improved.

Figure 4:
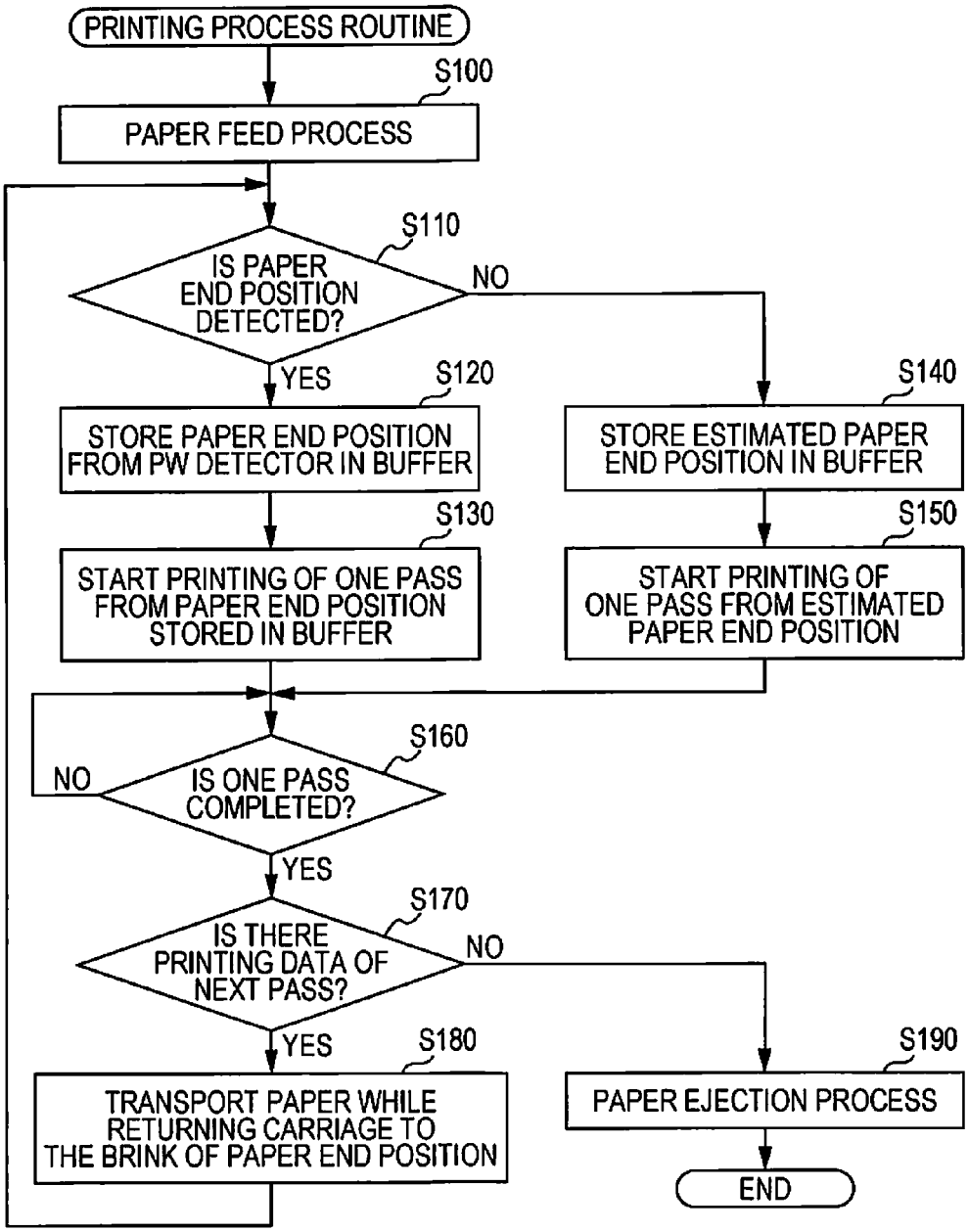
FIG. 4 is a flowchart illustrating an example of a printing process routine.

Next, an operation of the ink jet printer 20 of this embodiment configured as above will be described. FIG. 4 is a flowchart illustrating an example of a printing process routine performed by the controller 70. The routine is performed when the printing data is input from the user PC 10 in a state where the lenticular LC is selected as the recording paper P from the user PC 10. At this time, the carriage 22 is positioned at a CR movement start position of the home position side.

When the printing process routine is performed, first, the CPU 72 of the controller 70 performs a paper feed process in which the paper feed motor 33 is controlled such that the lenticular LC is fed onto the platen 40 as the recording paper P by the driving of the paper feed roller 35 (Step S100). At this time, the lenticular LC is fed by the paper feed motor 33 such that the end portion RE1 is disposed on the home position side of the platen 40.

Thus, the lenticular LC is fed onto the platen 40, and subsequently, it is determined whether or not the end portion RE1 of the lenticular LC is detected by using the signal from the PW detector 50 while the carriage motor 34*a* is controlled such that the carriage 22 is moved in the main scanning direction and separated from the home position (Step S110), and when the end portion of the lenticular LC is detected, a position of the carriage 22 at the time of detecting the end portion is stored in the buffer as a paper end position PE (Step S120). Then, the carriage motor 34*a* is controlled such that the carriage 22 is moved in the main scanning direction and further separated from the home position, and the printing head 24 is controlled such that an ink discharge having a color according to the printing data is started at the paper end position PE, and thus the printing of one pass is started (Step S130). Here, since the lens body R1 having high shape accuracy is disposed on the end portion RE1 of the lenticular LC, it is possible to discharge the ink onto a suitable position with respect to the lens body R1, and to land the ink onto the lenticular LC by detecting the end portion RE1 and starting the ink discharge from the end portion RE1. Accordingly, it is possible to improve printing quality.

Furthermore, for the printing, the PW detector 50 detects an edge 82A, and thus specifies a start position of the printing. At this time, the PW detector 50 may detect the cutout portion 87 by causing the carriage 22 to scan the cutout portion 87. Therefore, it is possible to suppress a printing error due to a mounting direction error of the lenticular LC by the user. That is, when the PW detector 50 detects the cutout portion 87 at the time of starting the printing, it is possible to determine that an estimated mounting direction of the lenticular LC is mounted in a direction reverse to the transport direction, and thus it is possible to perform printing from the end portion RE1 even when the lenticular LC is mounted in the direction reverse to the transport direction insofar as a direction for starting the ink discharge is able to be reversed with respect to the main scanning direction, thereby allowing printing quality to be improved. In addition, when the lenticular LC is mounted in a wrong direction by the user, the user may be notified to remount the lenticular LC. In addition, when printing is performed with respect to the lenticular LC without detecting the cutout portion 87, the mounting direction of the lenticular LC may be announced to the user in advance.

When the printing of one pass is completed by starting the printing as described above (Step S160), it is determined whether or not there is printing data for a next pass (Step S170), and when there is printing data for a next pass, the ink discharge is stopped, the carriage motor 34*a* is controlled such that the carriage 22 is moved toward the home position side to the brink of the paper end position PE stored in the buffer according to the process of Step 120, and the paper feed motor 33 is controlled such that the recording paper P of one pass is transported by the paper feed roller 35 (Step S180). When transportation of the recording paper P is stopped, the routine returns to the process of Step S110, and it is determined whether or not the paper end is detected by the PW detector 50 by using the signal from the PW detector 50 while the carriage motor 34*a* is controlled such that the carriage 22 is moved in the main scanning direction to be close to the home position. In the process of Step S180, when the carriage motor 34*a* is controlled such that the carriage 22 is moved at a velocity which is faster than a movement velocity of the carriage 22 at the time of performing printing, it is possible to move the carriage 22 faster, thereby allowing printing throughput to be improved.

Figure 5:
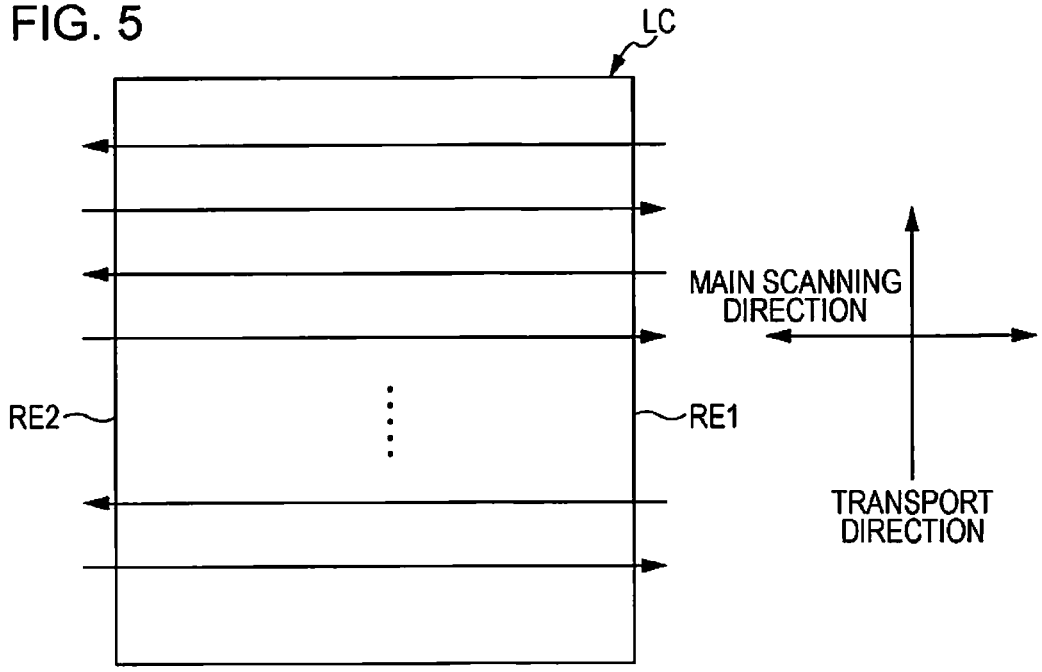
FIG. 5 is an explanatory diagram for explaining a printing direction with respect to the lenticular.

FIG. 5 is an explanatory diagram for explaining a printing direction with respect to the lenticular LC. For the lenticular LC, as illustrated, printing is performed while the carriage 22 is moved in a direction away from the home position side, that is, a direction toward the end portion RE2 from the end portion RE1, and when being moved in a direction to the end portion RE1 from the end portion RE2, the carriage 22 is moved without performing printing. In the lenticular LC, when it is not possible to discharge the ink onto the suitable position of the lens bodies R1 to Rn, a reverse view or the like is generated, and the image may not be viewed as a three-dimensional image. In this embodiment, the printing is started from the end portion RE1 conforming to the concave portion of the lens body R1 of the lenticular LC, and thus it is possible to discharge the ink onto the suitable position of the lens bodies R1 to Rn, thereby allowing printing quality to be improved. In addition, when the carriage 22 is moved in the direction to the end portion RE1 from the end portion RE2, the carriage 22 is moved at a velocity which is faster than a velocity at the time of moving the carriage 22 in the direction to the end portion RE2 from the end portion RE1 (Step S130), and thus it is possible to improve printing throughput.

Figure 6:
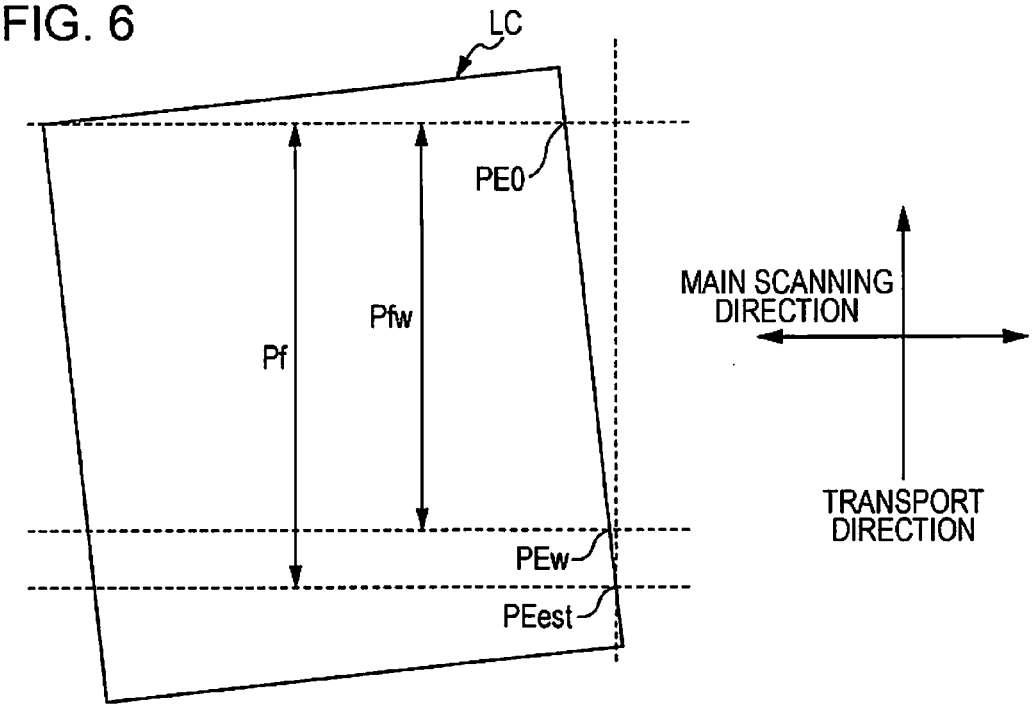
FIG. 6 is an explanatory diagram for explaining an estimation method of a paper end.

In the process of Step S110, when it is determined that the end portion RE1 of the lenticular LC is not detected, as illustrated in FIG. 6, the lenticular LC is shifted with respect to the main scanning direction of the carriage 22 and transported, and thus it is determined that the paper end is not able to be detected by the PW detector 50, and an estimated paper end position PEest is calculated by the following formula (1) and stored in the buffer (Step S140). Then, the carriage motor 34*a* is controlled such that the carriage 22 is moved in the main scanning direction from the estimated paper end position PEest and separated from the home position, and the printing head 24 is controlled such that the ink discharge having a color according to the printing data is started at the estimated paper end position PEest, and thus the printing of one pass is started (Step S150). Then, the processes after Step S160 are performed, and printing is performed with respect to the lenticular LC. In the formula (1), "PE0" is the paper end position detected at the first one pass, "PEw" is the paper end position detected by the PW detector 50 at the end and stored in the buffer, "Pfw" is a transport amount of the lenticular LC from the printing of the first one pass at the time of detecting the paper end position by the PW detector 50 at the end, and "Pf" is the transport amount of the lenticular LC from the printing of the first one pass to a current position. According to this process, even when the lenticular LC is shifted with respect to the main scanning direction of the carriage 22 and transported, it is possible to perform printing from the paper end position, thereby suppressing the image from being shifted.

$$PEest=PE0+(PEw-PE0)/Pfw\cdot Pf \quad (1)$$

Thus, at the time of repeating the processes of Steps S110 to S180, when it is determined that there is no printing data for a next pass (Step S170), a paper ejection process in which the paper feed motor 33 is controlled such that the recording paper P is ejected from the platen 40 by the driving of the paper feed roller 35 is performed (Step S190), and this routine is ended.

Here, a correspondence relationship of components of this embodiment and components of the invention will become apparent. The lenticular LC of this embodiment corresponds to a printing medium, and the controller 70 corresponds to a control unit.

According to the printing of this embodiment described above, the end portion RE1 of the lenticular LC is detected, and the ink discharge is started from the end portion RE1, thereby allowing printing quality to be improved. In addition, printing is not performed after the printing of the first one pass is ended, the carriage 22 is moved to the home position side at the velocity which is faster than the movement velocity of the carriage 22 at the time of performing printing, and thus it is possible to improve printing throughput. Further, when the paper end is not able to be detected by the PW detector 50, the estimated paper end position PEest is calculated, the carriage motor 34*a* is controlled such that the carriage 22 is separated from the home position and moved to the main scanning direction from the estimated paper end position PEest, and the printing head 24 is controlled such that the ink discharge having a color according to the printing data is performed from the estimated paper end position PEest, and thus the printing of one pass is started. Accordingly, even when the lenticular LC is shifted and transported, it is possible to suppress the image to be printed from being shifted, thereby allowing printing quality to be improved.

In the ink jet printer 20 of this embodiment, when it is determined that the end portion RE1 of the lenticular LC is not detected, the printing is started from the estimated paper end position PEest in the processes of Steps S110, S140, and S150, but the paper ejection may be performed or the processes of Steps S110 to S150 may not be performed when the end portion RE1 of the lenticular LC is not detected.

In the ink jet printer 20 of this embodiment, the end portion RE1 of the lenticular LC is detected by using the signal from the PW detector 50 while the carriage motor 34*a* is controlled such that the carriage 22 is moved to the main scanning direction from the home position in the process of Step S110, but the velocity of the carriage 22 at this time is able to be slower than the velocity of the carriage 22 at the time of discharging the ink. Accordingly, it is possible to more reliably detect the end portion RE1 of the lenticular LC.

In the ink jet printer 20 of this embodiment, the lenticular LC is fed by the paper feed motor 33 such that the end portion RE1 is disposed on the home position side of the platen 40, but a printing medium which is formed such that a part of an end portion having low shape accuracy is cut out may be used, and the PW detector 50 may detect the end portion in which a cutout portion is formed, thereby allowing the end portion having low shape accuracy to be easily detected. That is, when the width of the end portion RE1 and the width of the end portion RE2 are compared with each other, the end portion RE1 which is wide in width has high accuracy (strictly managed), and thus, for example, the PW detector 50 may detect the width of the lens positioned on the respective end portions, and printing may be performed from the end portion on which the lens having high accuracy is positioned.

In the ink jet printer 20 of this embodiment, the ink is discharged onto the recording paper P, but other liquids excepting the ink or liquids (dispersion liquids) having particles of a functional material dispersed therein, fluids such as a gel, or the like may be discharged.

In the ink jet printer 20 of this embodiment, printing is performed with respect to the recording paper P by moving the carriage 22 in the main scanning direction while the ink is discharged, but the ink jet printer may be configured as a line printer which performs printing of one pass with respect to the recording paper P by discharging the ink from lined up nozzles which are disposed in a direction substantially vertical to the transport direction of the recording paper P.

In the ink jet printer 20 of this embodiment, as the recording paper P, the lenticular lens is used, but a printing medium having other lens sheets such as a fly-eye lens in which a plurality of lens bodies are disposed in parallel may be used.

Furthermore, the invention is not limited to the embodiments described above, and it is obvious that the invention will be executed by various aspects within a technical range of the invention.

The invention is able to be used in a manufacturing industry of a printing apparatus or a printing medium, or the like.

What is claimed is:

1. A printing apparatus configured and arranged to perform printing by discharging fluid from a printing head onto a printing medium having a lens sheet in which a plurality of lens bodies are disposed in parallel, the printing apparatus comprising:

a control unit configured to control a fluid discharge, the printing medium having a first end portion and a second end portion, with one of the lens bodies being disposed on the first end portion and another of the lens bodies being disposed on the second end portion, a part of the another of the lens bodies disposed on the second end portion being cut out compared to a shape of the one of the lens bodies disposed on the first end portion, a printing head movement unit configured and arranged to reciprocate the printing head in a main scanning direction, an end portion detection unit configured and arranged to detect the first end portion of the printing medium in the main scanning direction, a transport unit configured and arranged to transport the printing medium to a fluid discharge region in which the printing head is able to discharge the fluid, the control unit controlling the fluid discharge so that the fluid is discharged onto the first end portion as a discharge start position, the control unit controlling the printing head and the printing head movement unit such that the control unit discharges the fluid onto the first end portion of the printing medium which is detected by the end portion detection unit as the discharge start position, the control unit controlling the printing head and the printing head movement unit such that the printing head moves while discharging the fluid when the printing head moves from the first end portion to the second end portion, and controlling the printing head and the printing head movement unit such that the printing head moves without discharging the fluid when the printing head moves from the second end portion to the first end portion, a movement velocity of the printing head when the printing head moves without discharging the fluid being faster than a movement velocity of the printing head when the printing head moves while discharging the fluid, and the control unit controlling the printing head movement unit, the end portion detection unit, and the transport unit such that the printing medium is transported by a predetermined amount and then the first end portion is detected by the end portion detection unit while the printing head moves from the second end portion to the first end portion, and controlling the printing head and the printing head movement unit such that a position of the first end portion is estimated on the basis of a transport amount according to the transport unit when the first end portion is not able to be detected by the end portion detection unit, and the fluid discharge is started from the estimated position of the first end portion.

2. The printing apparatus according to claim 1, wherein the control unit controls the printing head and the printing head movement unit such that the printing head discharges the fluid while the printing head moves from the first end portion to the second end portion.

3. The printing apparatus according to claim 2, wherein the end portion detection unit is attached to the printing head, and the control unit controls the printing head movement unit and the end portion detection unit such that the first end portion is detected by the end portion detection unit while the printing head moves from the second end portion to the first end portion, and then controls the printing head and the printing head movement unit such that the fluid discharge is started from a position of the detected end portion while the printing head moves from the first end portion to the second end portion.

4. The printing apparatus according to claim 2, wherein the end portion detection unit is attached to the printing head, and the control unit controls the printing head movement unit and the end portion detection unit such that the first end portion of the printing medium is detected by the end portion detection unit while the velocity of the printing head is decelerated.

5. A printing method in which printing is performed by discharging fluid from a printing head onto a printing medium having a lens sheet in which a plurality of lens bodies are disposed in parallel, the printing medium having a first end portion and a second end portion, with one of the lens bodies being disposed on the first end portion and another of the lens bodies being disposed on the second end portion, a part of the another of the lens bodies disposed on the second end portion being cut out compared to a shape of the one of the lens bodies disposed on the first end portion, the printing method comprising:

reciprocating the printing head in a main scanning direction, detecting the first end portion of the printing medium in the main scanning direction, transporting the printing medium to a fluid discharge region in which the printing head is able to discharge the fluid, performing the printing by discharging the fluid from the printing head onto the first end portion detected by the detecting as a discharge start position, performing the printing by moving the printing head while discharging the fluid when the printing head moves from the first end portion to the second end portion, and performing the printing by moving the printing head without discharging the fluid when the printing head moves from the second end portion to the first end portion, a movement velocity of the printing head when the printing head moves without discharging the fluid being faster than a movement velocity of the printing head when the printing head moves while discharging the fluid, and performing the printing by transporting the printing medium by a predetermined amount and then detecting the first end portion by the end portion detection unit while the printing head moves from the second end portion to the first end portion, and performing the printing by estimating a position of the first end portion on the basis of a transport amount according to the transport unit when the first end portion is not able to be detected by the end portion detection unit, and by starting the fluid discharge from the estimated position of the first end portion.

6. A printing apparatus configured and arranged to perform printing by discharging fluid from a printing head onto a printing medium having a lens sheet in which a plurality of lens bodies are disposed in parallel, the printing apparatus comprising:

a control unit configured to control a fluid discharge, the printing medium having a first end portion and a second end portion, on each of which a lens body among the lens bodies is disposed, a width of the lens body disposed on the first end portion being wider than a width of the lens body disposed on the second end portion and being the same as widths of the lens bodies disposed on positions other than on the second end portion, a printing head movement unit configured and arranged to reciprocate the printing head in a main scanning direction, an end portion detection unit configured and arranged to detect the first end portion of the printing medium in the main scanning direction, a transport unit configured and arranged to transport the printing medium to a fluid discharge region in which the printing head is able to discharge the fluid, the control unit controlling the fluid discharge so that the fluid is discharged onto the first end portion as a discharge start position, the control unit controlling the printing head and the printing head movement unit such that the control unit discharges the fluid onto the first end portion of the printing medium which is detected by the end portion detection unit as the discharge start position, the control unit controlling the printing head and the printing head movement unit such that the printing head moves while discharging the fluid when the printing head moves from the first end portion to the second end portion, and controlling the printing head and the printing head movement unit such that the printing head moves without discharging the fluid when the printing head moves from the second end portion to the first end portion, a movement velocity of the printing head when the printing head moves without discharging the fluid being faster than a movement velocity of the printing head when the printing head moves while discharging the fluid, and the control unit controlling the printing head movement unit, the end portion detection unit, and the transport unit such that the printing medium is transported by a predetermined amount and then the first end portion is detected by the end portion detection unit while the printing head moves from the second end portion to the first end portion, and controlling the printing head and the printing head movement unit such that a position of the first end portion is estimated on the basis of a transport amount according to the transport unit when the first end portion is not able to be detected by the end portion detection unit, and the fluid discharge is started from the estimated position of the first end portion.

* * * * *